US005599220A

United States Patent [19]

Smith

[11] Patent Number: 5,599,220

[45] Date of Patent: Feb. 4, 1997

[54] METHOD AND APPARATUS FOR VIEWING OBJECTS UNDERWATER

[76] Inventor: Nico Smith, 704 Campus Dr. 6H Rains Houses, Stanford, Calif. 94305

[21] Appl. No.: 455,198

[22] Filed: Jun. 1, 1995

[51] Int. Cl.[6] ..... B63C 11/00

[52] U.S. Cl. ..... 441/135

[58] Field of Search ..... 441/135; 114/66; 351/43

[56] References Cited

U.S. PATENT DOCUMENTS 2,712,139 7/1955 Kelly ..... 441/135

4,145,783 3/1979 Rhodes ..... 441/135

4,844,595 7/1989 Nealy ..... 441/135

5,074,816 12/1991 Holford ..... 441/135

*Primary Examiner*—Stephen Avila

[57] ABSTRACT

A method and apparatus for viewing beneath the surface of water, to be used by a person or persons located either in or out of the water. A transparent convex or concave element is located in a bouyant cavity such that when the cavity is filled with water, the water in combination with the convex or concave element creates a lensing action.

12 Claims, 5 Drawing Sheets

METHOD AND APPARATUS FOR VIEWING OBJECTS UNDERWATER

FIELD OF THE INVENTION

This invention relates to underwater viewing devices and specifically to a water lens within a floatation housing which uses the water that it is floating in to create image enhancement.

BACKGROUND OF THE INVENTION

Other underwater viewing devices include such things as diving masks, air mattresses with windows, and glass bottom boats. None of these devices are intended to enhance images, for example by magnifying or giving wide-angle views. Another disadvantage is that these devices either require the user and/or the masks to be submerged in the water or are large and unwieldy. Often these devices can only be used by one person at a time.

U.S. Pat. No. 4,145,783 (Rhodes) describes a window within a floation housing where the housing is used for the collection and storage of items and the window lies beneath the surface of the water. Having the window below the surface of the water cuts down on visibility from the sides of the device, and forces the viewer to position him/herself directly over the window. This means the viewer must be standing in the water. Another disadvantage to having the window below the surface of the water is that water can be splashed and will collect in pools on the surface of the window which will cut down on the viewing area. Another disadvantage of this configuration is that the window is always and only parallel to the surface of the water.

U.S. Pat. No. 3,808,621 (French) describes a swimmer's viewing float. This patent mentions a lensing action stemming from the convexity of the float's bottom surface. It is the hollow air filled space between the two surfaces of the float that French claims creates the lens and not the water that the float is in. Again, water is not brought in any way into the device. Also the user is completely in the water while using the swimmer's float.

All art referenced above, including both patents and underwater viewing devices on the market, are designed to keep water out of an apparatus. The present invention requires that water be brought into a cavity to activate the image enhancement (lensing action). Also most devices require the viewer to be in the water with the device, and most of these devices are more than two parts. The present invention can be used with the viewer either in or out of the water, and is at most only two parts.

OBJECTS AND ADVANTAGES

Several objects and advantages of the present invention are:

(1) to provide an apparatus for viewing underwater artifacts, specimens, and terrain inexpensively, with magnification;

(2) to use the water that the device is in to create the lens, adding an element of "magic" and fun to the device in that outside of the water, the plastic is transparent and there is no image enhancement but once the water fills the lens, image enhancement occurs;

(3) to have the device free floating allowing for ease of movement along the surface of the water;

(4) to have the device small and free floating allowing many people to look through it at the same time. This is particularly advantageous in a scenario and embodiment of the device where the device is being used to teach, non-destructively, about water environments;

(5) to provide a device that requires the lens to be filled with water, thus discouraging users from taking objects out of the water in order to look at them (i.e. to provide a device that is not a 'container' for specimens);

(6) to provide an underwater viewing device with a lensing system that must be filled with water thereby creating a physical, instructional description of the phenomena of how lenses work;

(7) To provide a system with a minimum of hardware components that uses the water that the device is in, as a substantial part of the lensing system (a substantial part of the magnification means, and thus, most of the functionality of the device, is free).

SUMMARY

In order for the lens in the present invention to work as described the water is pulled above the water surface, such as by the buoyancy of my device, and held there by a naturally created vacuum. My device uses the water integrally. Also, since the apparatus is filled with water, creating a magnifying lens, the apparatus can be tilted and doen't have to be maintained parallel to the water's surface. Another advantage of my invention is that it is not only for use outside or possibly in a swimming pool, but it is also useful and fun in a bathtub, wading pool or even a kitchen sink. A small embodiment of the invention could be used in fishtanks.

Another advantage of my device is that it will be useful in nature and science exploration and for educational purposes. The fact that the device needs the lens to be filled with water is advantageous in that people are discouraged from taking things and living specimens out of the water in order to look at them. In this way, this device will give adults and children a learning tool that is also designed to minimize human impact on water environments. Once they take the apparatus out of the water the viewing window is transparent, it will not magnify or give wide angle views.

The present invention can be used while in the water but also can be used while sitting or standing next to water and can be used by many people at the same time.

This is advantageous from an environmental point of view in that it is easy to use while standing next to the water, you don't need to stand or swim in the water. Different means for getting the air out of the viewing surface and the water into the viewing surface are possible. Pivoting mechanisms, visual clues and one-way valves could also be used.

DESCRIPTION OF THE INVENTION AND DRAWINGS

FIG.1 is an isomectric view of an embodiment of the present invention. The viewing surface 1 is shown in this embodiment to of a partial dome shae. This truncated hemisphere must have a height less that the diameter of the sphere in order for the apparatus to have a useful focal point, one that falls within the water and not internal to the sphere. The whole apparatus can be submerged partially and the focal point changes as more or less of the sphere is exposed. The diameter of the sphere will determine the power of the magnification. The means for grasping the apparatus is shown in this embodiment as 2. If this "ring" is of bouyant material, such as kickboard foam (EVA) or is blow molded (air filled) part, the extent to which the apparatus lies parallel to the surface of the water depends on the symmetry of this part. Two possible alternate forms for this "ring" are shown in FIG. 8 and FIG. 9.

Figure 1:
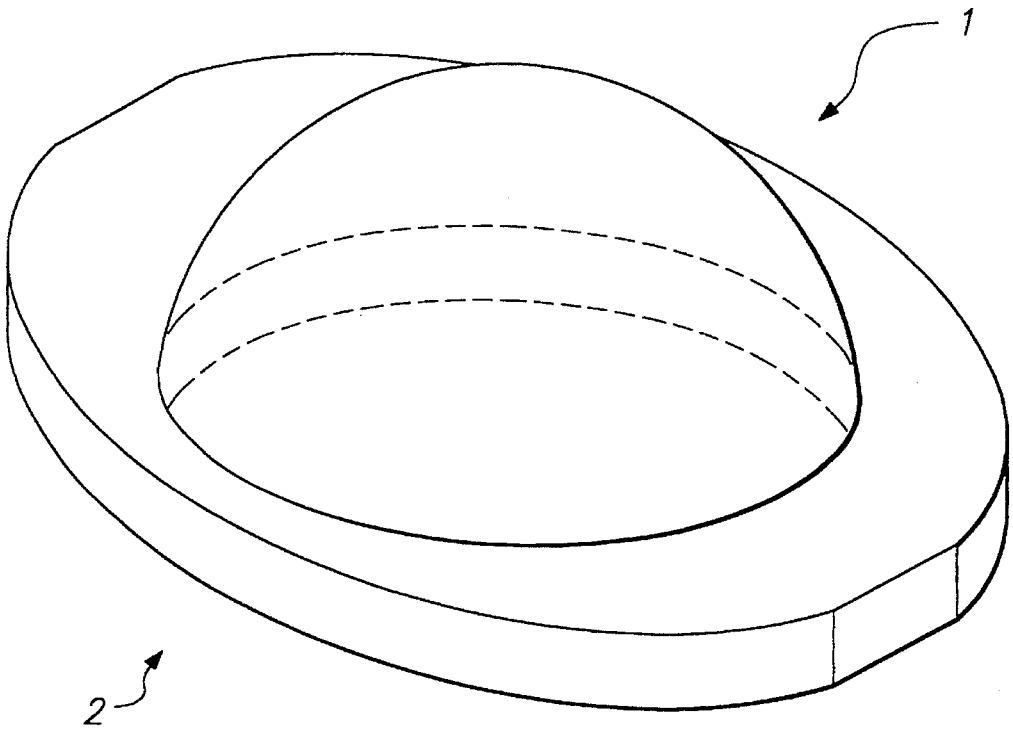
Figure 2:
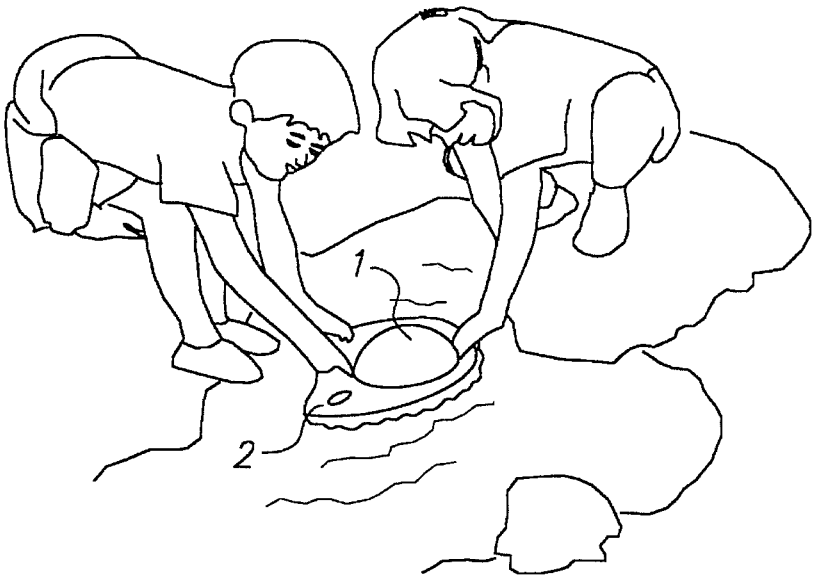
FIG.2 illustrates the apparatus for viewing objects underwater in use. The truncated hemisphere shape allows the viewers to sit safely on the shore while using the apparatus.
Figure 3:
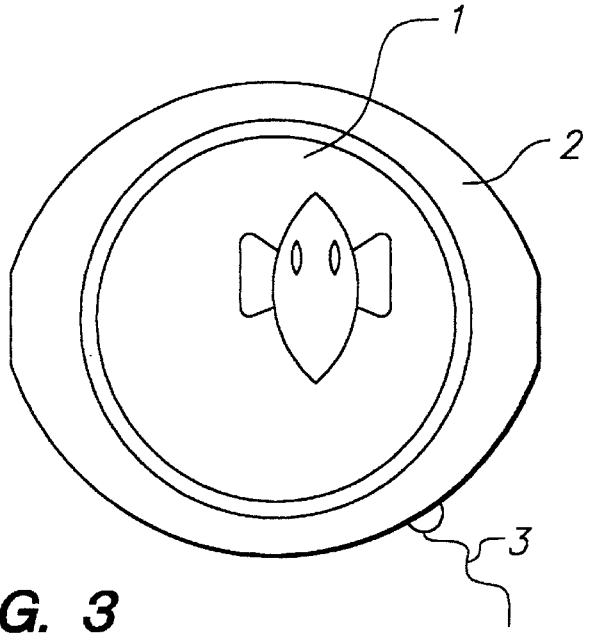
FIG.3 is a top view of an embodiment of the present invention. This figure show a tethering cord, 3, connected to the grasping means of the apparatus.
Figure 4:
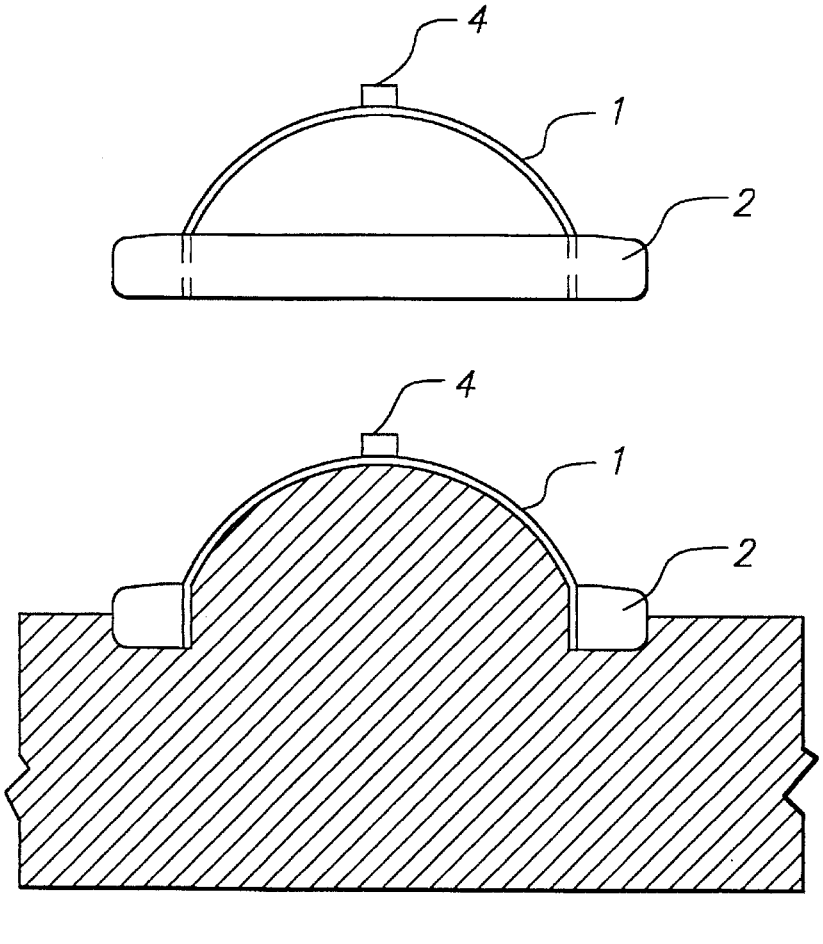

FIG.4 shows a section view of an embodiment of the invention in air and in water. Also in this figure is an embodiment of the device including a one way valve, 4, as an alternate way to fill the viewing surface with water. This figure also illustrates the waterline when the viewing surface is full of water.

Figure 5:
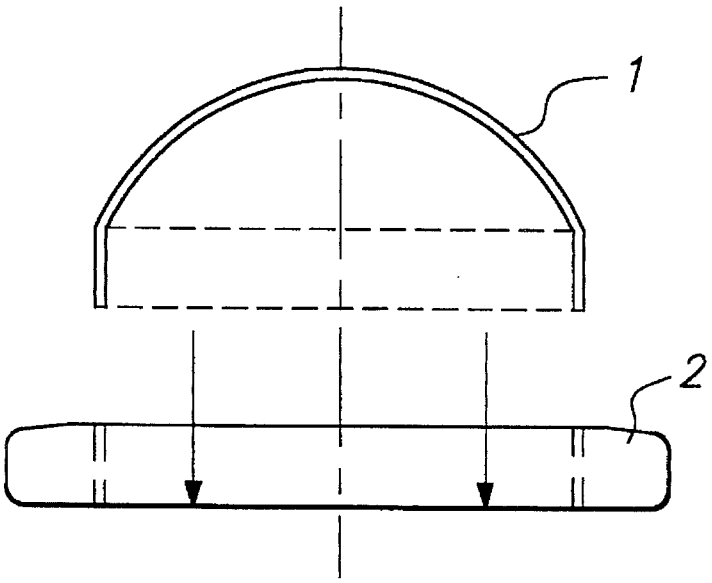

FIG.5 is an assembly drawing showing the possibility of two parts for the viewing and floatation sections for an embodiment of the present invention. These two parts, the viewing surface and the grasping means, could be joined together permanently or "lenses" of different shapes and sizes could be snapped in and out to vary magnification effects.

Figure 6:
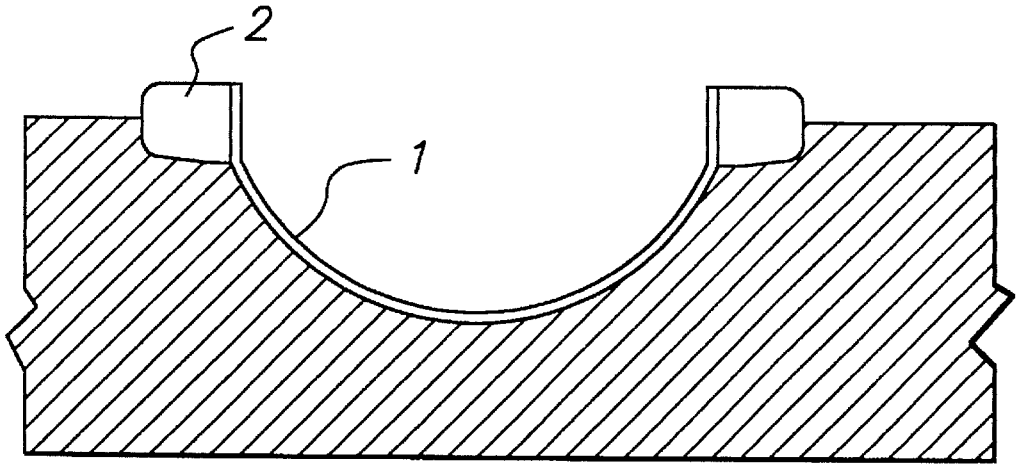

FIG.6 shows an embodiment of the invention for wide-angle views. The water surface along the convex side of the transparent viewing surface will create a wideangle view into the water. In this configuration the means for grasping could include a weighting element to keep the viewing surface submerged.

Figure 7A:
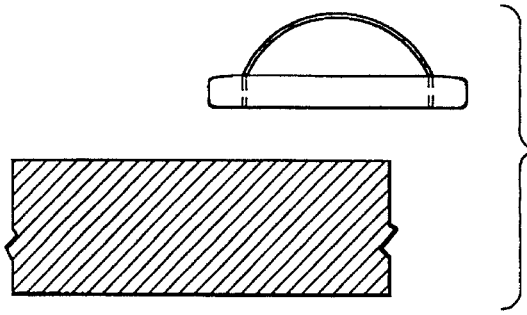
Figure 7B:
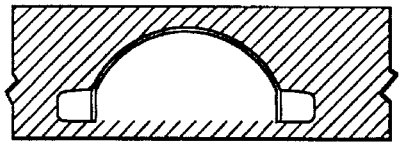
Figure 7C:
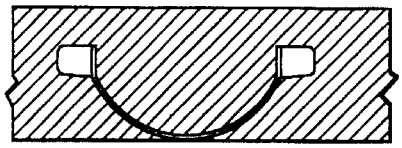
Figure 7D:
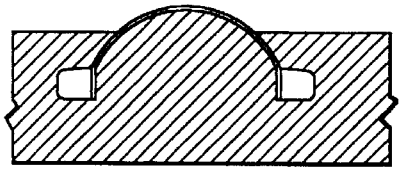
Figure 7E:
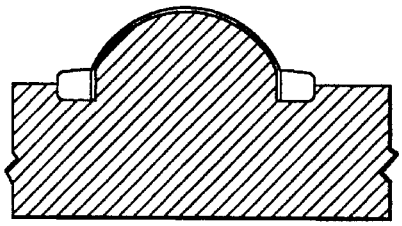

FIGS. 7A–7E illustrate the steps for freeing trapped air within the viewing surface. Initially the apparatus is outside the water, FIG. 7A. The apparatus is then submerged, FIG. 7B. The apparatus is flipped to an angle greater than perpendicular with respect to the water surface, FIG. 7C. The air bubbles float up to the surface and water fills the lens. The apparatus is then positioned within the water so that the viewing surface is facing towards the sky, FIG. 7D. The viewing surface, FIG. 7E is then moved at least partially above the surface of the water and a lens is formed with the water which is held above the surface of the water using a vacuum formed by the viewing surface. If the grasping means is bouyant the apparatus floats back to the surface of the water, until the bouyancy of the material is in equilibrium with the force of the water within the lens pulling down. A possible equilibrium condition is shown in 9.

Figure 8A:
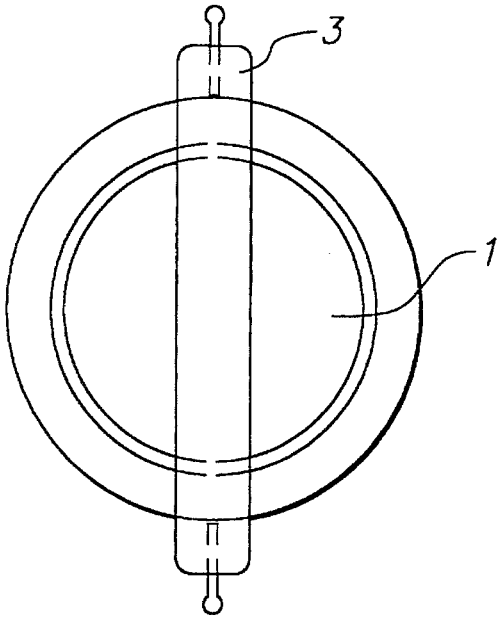
Figure 8B:
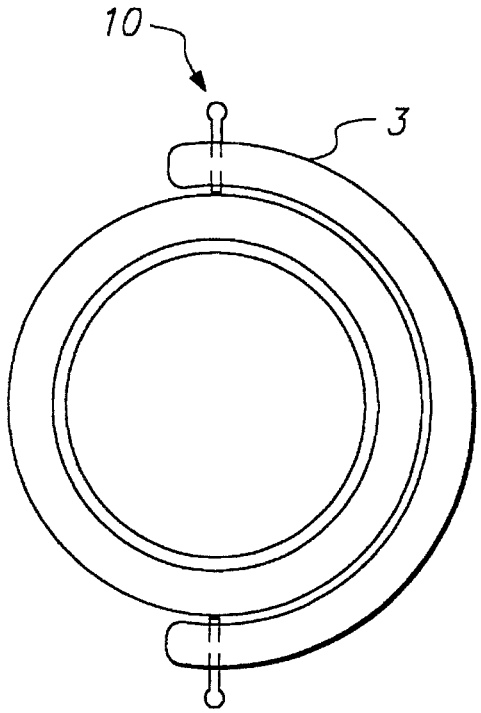

FIGS. 8A and 8B show an embodiment of the invention where the viewing surface is pivoted with respect to the grasping means. This embodiment is shown in two positions. 10 is a pivot.

Figure 9:
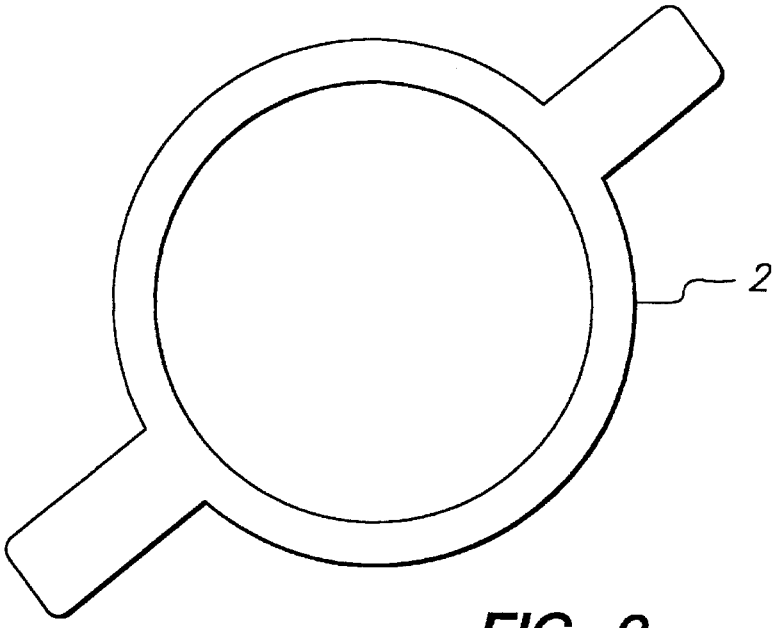

FIG. 9 shows an embodiment where the grasping means is designed to encourage a rotation action.

I claim:

1. An apparatus for viewing objects under water from above the surface of the water, comprising:

a viewing means, the viewing means being substantially transparent and having a semispherical concave surface and a semispherical convex surface closely spaced from one another and an edge; and buoyant means for grasping the apparatus coupled to the edge of the viewing means;

wherein when the viewing means is moved from a position submerged in water to a position at least partially above the surface of the water, a lens is formed with the viewing means and the water which is held above the surface of the water using a vacuum formed by the viewing means.

2. The apparatus of claim 1 wherein said grasping means is a bouyant material.

3. The apparatus of claim 1 wherein said viewing surface is plastic.

4. The apparatus of claim 1 wherein said viewing surface with water creates a magnifying lens.

5. The apparatus of claim 1 wherein said viewing surface with water creates a wide-angle lens.

6. The apparatus of claim 1 wherein said grasping means is designed to encourage a rotation action for air expulsion from the lens.

7. The apparatus of claim 1 wherein a tether is added to connect the apparatus in some way to the human viewer, or a stationary object.

8. The apparatus in claim 1 wherein the viewing surface is integral to a means of flotation.

9. The apparatus in claim 1 wherein the viewing surface snaps into and out of the grasping means so that different surfaces could be coupled with the grasping means.

10. The device of claim 6 wherein said viewing surface contains a one-way valve to release the air from the beneath the viewing surface while allowing water in.

11. The apparatus of claim 6 wherein the viewing surface pivots within a flotation housing.

12. Method for viewing objects under water from above the surface of the water using a viewing means, the viewing means being characterized by a semispherical concave surface and a closely spaced semispherical convex surface, the method comprising the steps of:

grasping a buoyant housing containing the viewing means;

submerging the viewing means under water;

removing substantially all air from within the viewing means, thereby filling the volume defined by the concave surface with water;

raising the viewing means so that at least a portion of the convex surface is above the surface of the water, the water held by vacuum within the volume defined by the concave surface being raised above the surface of the water forming a lens with the viewing means; and viewing objects through the viewing means and the water held within the viewing means.

* * * * *